US009953573B2

(12) United States Patent
Pyo et al.

(10) Patent No.: US 9,953,573 B2
(45) Date of Patent: Apr. 24, 2018

(54) ORGANIC LIGHT-EMITTING DIODE (OLED) DISPLAY AND METHOD OF SETTING INITIALIZATION VOLTAGE IN THE SAME

(71) Applicant: Samsung Display Co., Ltd., Yongin, Gyeonggi-do (KR)

(72) Inventors: Si-Beak Pyo, Cheonan-si (KR); Jung-Kook Park, Cheonan-si (KR); Sang-Min Lim, Cheonan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 117 days.

(21) Appl. No.: 14/668,798

(22) Filed: Mar. 25, 2015

(65) Prior Publication Data

US 2015/0364089 A1 Dec. 17, 2015

(30) Foreign Application Priority Data

Jun. 11, 2014 (KR) ..... 10-2014-0071109

(51) Int. Cl.
*G09G 3/30* (2006.01)
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01); *G09G 2300/0842* (2013.01); *G09G 2300/0861* (2013.01); *G09G 2310/0251* (2013.01); *G09G 2310/0254* (2013.01); *G09G 2310/0256* (2013.01); *G09G 2330/028* (2013.01)

(58) Field of Classification Search
CPC ..... G09G 3/3258; G09G 2330/00
USPC ..... 345/77
See application file for complete search history.

(56) References Cited

U.S. PATENT DOCUMENTS

2009/0079727 A1* 3/2009 Ozawa ..... G09G 3/3233 345/214
2009/0091562 A1* 4/2009 Uchino ..... G09G 3/3233 345/214
2009/0219231 A1 9/2009 Yamamoto et al.
2011/0221784 A1 9/2011 Lee et al.
(Continued)

FOREIGN PATENT DOCUMENTS

KR 10-2009-0093826 A 9/2009
KR 10-2011-0103755 A 9/2011
(Continued)

*Primary Examiner* — Long D Pham
(74) *Attorney, Agent, or Firm* — Knobbe Martens Olson & Bear LLP

(57) ABSTRACT

An organic light-emitting diode (OLED) display is disclosed. In one aspect, the display includes a display panel including a plurality of pixels, each of the pixels including an OLED and a driving transistor, the OLED configured to emit light based on an emission current, the driving transistor configured to control the emission current based on a data signal applied to a gate electrode of the driving transistor. The display also includes a power supply configured to apply a driving voltage to the pixels, apply an initialization voltage to a first electrode of the OLED, control the driving voltage within a first range, and control the initialization voltage such that a voltage difference between the driving voltage and the initialization voltage is substantially constant.

21 Claims, 4 Drawing Sheets

(56) References Cited

U.S. PATENT DOCUMENTS

| | | | | |
|---|---|---|---|---|
| 2013/0002616 | A1* | 1/2013 | Kim | H01L 29/78615 345/204 |
| 2013/0194316 | A1 | 8/2013 | Park et al. | |
| 2013/0222356 | A1* | 8/2013 | Jeong | G09G 3/3233 345/211 |
| 2013/0278587 | A1* | 10/2013 | Kawano | G09G 3/3233 345/212 |
| 2014/0028649 | A1 | 1/2014 | Kim et al. | |
| 2014/0125714 | A1 | 5/2014 | Pyo | |

FOREIGN PATENT DOCUMENTS

| | | | |
|---|---|---|---|
| KR | 10-2013-0086877 | A | 8/2013 |
| KR | 10-2014-0014671 | A | 2/2014 |
| KR | 10-2014-0058283 | A | 5/2014 |
| KR | 10-2015-0010807 | A | 1/2015 |
| KR | 10-2015-0040095 | A | 4/2015 |
| KR | 10-2015-0056940 | A | 5/2015 |

* cited by examiner

ORGANIC LIGHT-EMITTING DIODE (OLED) DISPLAY AND METHOD OF SETTING INITIALIZATION VOLTAGE IN THE SAME

INCORPORATION BY REFERENCE TO ANY PRIORITY APPLICATIONS

This application claims priority under 35 USC § 119 to Korean Patent Application No. 10-2014-0071109, filed on Jun. 11, 2014 in the Korean Intellectual Property Office (KIPO), the contents of which are herein incorporated by reference in their entirety.

BACKGROUND

Field

The described technology generally relates to display devices, and more particularly to organic light-emitting diode (OLED) displays and methods of setting initialization voltages in the OLED displays.

Description of the Related Technology

An OLED display includes a plurality of OLEDs and displays images by controlling currents flowing through the OLEDs. Generally, an OLED has two electrodes, and a parasitic capacitor is connected in parallel to the OLED. One electrode (e.g., an anode electrode) of the OLED is initialized in every frame based on an initialization voltage. The OLED emits light when a voltage difference between two OLED electrodes is greater than a threshold voltage after the initialization. Thus, in order for the OLED to emit light, the predetermined amount of electric charge should be stored in the parasitic capacitor.

Typically, a green OLED that outputs green light will have relatively high emission efficiency. In addition, a green parasitic capacitor connected in parallel to the green OLED has relatively large capacitance. In other words, the capacitance of the green parasitic capacitor will be greater than that of the parasitic capacitor connected in parallel to a red OLED and a capacitance of a parasitic capacitor connected in parallel to a blue OLED. Thus, the amount of electric charge required for the green OLED to emit light will be greater than the amount of electric charge required for the other OLEDs (e.g., red and blue OLEDs) to emit light.

SUMMARY OF CERTAIN INVENTIVE ASPECTS

One inventive aspect is an OLED display for effectively preventing color artifacts.

Another aspect is a method of setting an initialization voltage in an OLED display.

Another aspect is an OLED display which includes a display panel and a power supply. The display panel includes a plurality of pixels. Each of the plurality of pixels includes an OLED and a driving transistor. The OLED emits light based on an emission current. The driving transistor controls the emission current based on a data signal applied to a gate electrode of the driving transistor. The power supply applies a driving voltage to the plurality of pixels, applies an initialization voltage to a first electrode of the OLED, controls the driving voltage within a first range, and controls the initialization voltage such that a voltage difference between the driving voltage and the initialization voltage is substantially fixed.

In an example embodiment, the power supply may control the driving voltage based on a luminance mode of the display panel.

In an example embodiment, the power supply may control the driving voltage within the first range such that the driving transistor operates in a saturation region.

In an example embodiment, the power supply may control the driving voltage within the first range such that the driving transistor operates adjacent to a boundary between a saturation region and a linear region.

In an example embodiment, the power supply may set the initialization voltage by adding a reverse voltage to the driving voltage. The reverse voltage may correspond to a voltage difference between the first electrode and a second electrode of the OLED when the OLED does not emit.

In an example embodiment, the reverse voltage may be set for each pixel. A first reverse voltage for a first pixel among the plurality of pixels may be different from a second reverse voltage for a second pixel among the plurality of pixels.

In an example embodiment, the first pixel may be one of a red pixel outputting red light, a green pixel outputting green light and a blue pixel outputting blue light. The second pixel may be another one of the red pixel, the green pixel and the blue pixel.

In an example embodiment, an absolute value of the reverse voltage may be equal to or smaller than (Vth−Qe/Cel), where Vth represents a threshold voltage of the driving transistor, Qe represents an amount of electric charges included in the emission current during an emission period in a single frame when the OLED has zero luminance, and Cel represents a capacitance of a parasitic capacitor connected in parallel to the OLED.

In an example embodiment, the power supply may include an adder. The adder may add the reverse voltage to the driving voltage.

In an example embodiment, the first electrode of the OLED may correspond to an anode electrode of the OLED.

In an example embodiment, the OLED display may further include a timing controller. The timing controller may perform a gamma compensating operation on the data signal based on changes of the driving voltage and the initialization voltage. The initialization voltage may be applied to the gate electrode of the driving transistor.

In an example embodiment, when the data signal applied to the gate electrode of the driving transistor corresponds to zero luminance, a bypass for the emission current may be formed by a parasitic capacitor connected in parallel to the OLED.

According to example embodiments, in a method of setting an initialization voltage in an OLED display including a plurality of pixels, a driving voltage is controlled within a first range. The initialization voltage is controlled such that a voltage difference between the driving voltage and the initialization voltage is substantially fixed. Each of the plurality of pixels includes an OLED emitting based on an emission current and a driving transistor controlling the emission current based on a data signal applied to a gate electrode of the driving transistor. The driving voltage is applied to the plurality of pixels. The initialization voltage is applied to a first electrode of the OLED.

In an example embodiment, in controlling the driving voltage, the driving voltage may be controlled based on a luminance mode of the OLED display.

In an example embodiment, in controlling the driving voltage, the driving voltage may be controlled within the first range such that the driving transistor operates in a saturation region.

In an example embodiment, in controlling the driving voltage, the driving voltage may be controlled within the first range such that the driving transistor operates in a boundary region between a saturation region and a linear region.

In an example embodiment, in controlling the driving voltage, the initialization voltage may be set by adding a reverse voltage to the driving voltage. The reverse voltage may correspond to a voltage difference between the first electrode and a second electrode of the OLED when the OLED does not emit light.

In an example embodiment, an absolute value of the reverse voltage may be equal to or smaller than (Vth−Qe/Cel), where Vth represents a threshold voltage of the driving transistor, Qe represents an amount of electric charges included in the emission current during an emission period in a single frame when the OLED has zero luminance, and Cel represents a capacitance of a parasitic capacitor connected in parallel to the OLED.

In an example embodiment, a gamma compensating operation may be further performed on the data signal based on changes of the driving voltage and the initialization voltage. The initialization voltage may be applied to the gate electrode of the driving transistor. In an example embodiment, when the data signal applied to the gate electrode of the driving transistor corresponds to zero luminance, a bypass for the emission current may be formed by a parasitic capacitor connected in parallel to the OLED.

Another aspect is an organic light-emitting (OLED) display comprising: a display panel including a plurality of pixels, each of the pixels including an OLED and a driving transistor, the OLED configured to emit light based on an emission current, the driving transistor configured to control the emission current based on a data signal applied to a gate electrode of the driving transistor; and a power supply configured to apply a driving voltage to the pixels, apply an initialization voltage to a first electrode of the OLED, control the driving voltage within a first range, and control the initialization voltage such that a voltage difference between the driving voltage and the initialization voltage is substantially constant.

In the above display, the power supply is configured to control the driving voltage based on a luminance mode of the display panel. In the above display, wherein the power supply is configured to control the driving voltage within the first range such that the driving transistor operates in a saturation region. In the above display, the power supply is configured to control the driving voltage within the first range such that the driving transistor operates adjacent to a boundary between a saturation region and a linear region. In the above display, the power supply is configured to set the initialization voltage by adding a reverse voltage to the driving voltage, the reverse voltage corresponding to a voltage difference between the first electrode and a second electrode of the OLED when the OLED does not emit light. In the above display, the reverse voltage is configured to be set for each pixel, and a first reverse voltage for a first pixel among the pixels is different from a second reverse voltage for a second pixel among the pixels.

In the above display, the first pixel is one of a red pixel configured to emit red light, a green pixel configured to emit green light and a blue pixel configured to emit blue light, and wherein the second pixel is another one of the red pixel, the green pixel and the blue pixel. In the above display, an absolute value of the reverse voltage is less than or substantially equal to (Vth−Qe/Cel), where Vth represents a threshold voltage of the driving transistor, Qe represents an amount of electric charges included in the emission current during an emission period in a single frame when the OLED has zero luminance, and Cel represents a capacitance of a parasitic capacitor connected in parallel to the OLED. In the above display, the power supply includes an adder configured to add the reverse voltage to the driving voltage. In the above display, the first electrode of the OLED corresponds to an anode electrode of the OLED.

The above display further comprises: a timing controller configured to perform a gamma compensating operation on the data signal based on changes of the driving voltage and the initialization voltage, and wherein the gate electrode of the driving transistor is configured to receive the initialization voltage. In the above display, when the data signal applied to the gate electrode of the driving transistor corresponds to zero luminance, a parasitic capacitor connected in parallel to the OLED is configured to form a bypass for the emission current.

Another aspect is a method of setting an initialization voltage in an organic light-emitting diode (OLED) display including a plurality of pixels, each of the pixels including an OLED configured to emit light based on an emission current and a driving transistor configured to control the emission current based on a data signal applied to a gate electrode of the driving transistor, the method comprising: controlling a driving voltage within a first range, the driving voltage being applied to the pixels; and controlling the initialization voltage such that a voltage difference between the driving voltage and the initialization voltage is substantially constant, the initialization voltage being applied to a first electrode of the OLED.

In the above method, the controlling of the driving voltage includes: controlling the driving voltage based on a luminance mode of the OLED display. In the above method, the controlling of the driving voltage includes: controlling the driving voltage within the first range such that the driving transistor operates in a saturation region. In the above method, the controlling of the initialization voltage includes: controlling the driving voltage within the first range such that the driving transistor operates in a boundary region between a saturation region and a linear region. In the above method, the controlling of the driving voltage includes: setting the initialization voltage by adding a reverse voltage to the driving voltage, the reverse voltage corresponding to a voltage difference between the first electrode and a second electrode of the OLED when the OLED does not emit light.

In the above method, an absolute value of the reverse voltage is less than or substantially equal to (Vth−Qe/Cel), where Vth represents a threshold voltage of the driving transistor, Qe represents an amount of electric charges included in the emission current during an emission period in a single frame when the OLED has zero luminance, and Cel represents a capacitance of a parasitic capacitor connected in parallel to the OLED. The above method further comprises: performing a gamma compensating operation on the data signal based on changes of the driving voltage and the initialization voltage, and wherein the initialization voltage is applied to the gate electrode of the driving transistor. In the above method, when the data signal applied to the gate electrode of the driving transistor corresponds to zero luminance, a bypass for the emission current is formed by a parasitic capacitor connected in parallel to the OLED.

Another aspect is an OLED display which includes a display panel and a power supply. The power supply applies a driving voltage and an initialization voltage to the display panel, and controls the initialization voltage such that a voltage difference between the driving voltage and the initialization voltage is substantially fixed. The power supply includes an adder configured to add a constant voltage to the driving voltage to generate the initialization voltage.

In an example embodiment, the display panel may include a plurality of pixels each of which includes an OLED and a driving transistor. The constant voltage may correspond to a voltage difference between a first electrode and a second electrode of the OLED when the OLED does not emit light.

In an example embodiment, the first electrode of the OLED may correspond to an anode electrode of the OLED. The initialization voltage is applied to the anode electrode of the OLED.

In an example embodiment, the power supply may be further configured to control the driving voltage within a first range.

In an example embodiment, the power supply may include an amplifier, a first resistor, a second resistor and a third resistor. The amplifier may include a first input electrode connected to a ground voltage, a second input electrode, and an output electrode outputting the initialization voltage. The first resistor may be connected between the constant voltage and the second input electrode of the amplifier. The second resistor may be connected between the driving voltage and the second input electrode of the amplifier. The third resistor may be connected between the second input electrode of the amplifier and the output electrode of the amplifier.

Accordingly, in the OLED display and the method of setting the initialization voltage in the OLED display according to example embodiments, the initialization voltage may be controlled such that the voltage difference between the driving voltage and the initialization voltage is substantially fixed, and thus the color artifacts in the display panel may be prevented.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF CERTAIN INVENTIVE EMBODIMENTS

Figure 1:
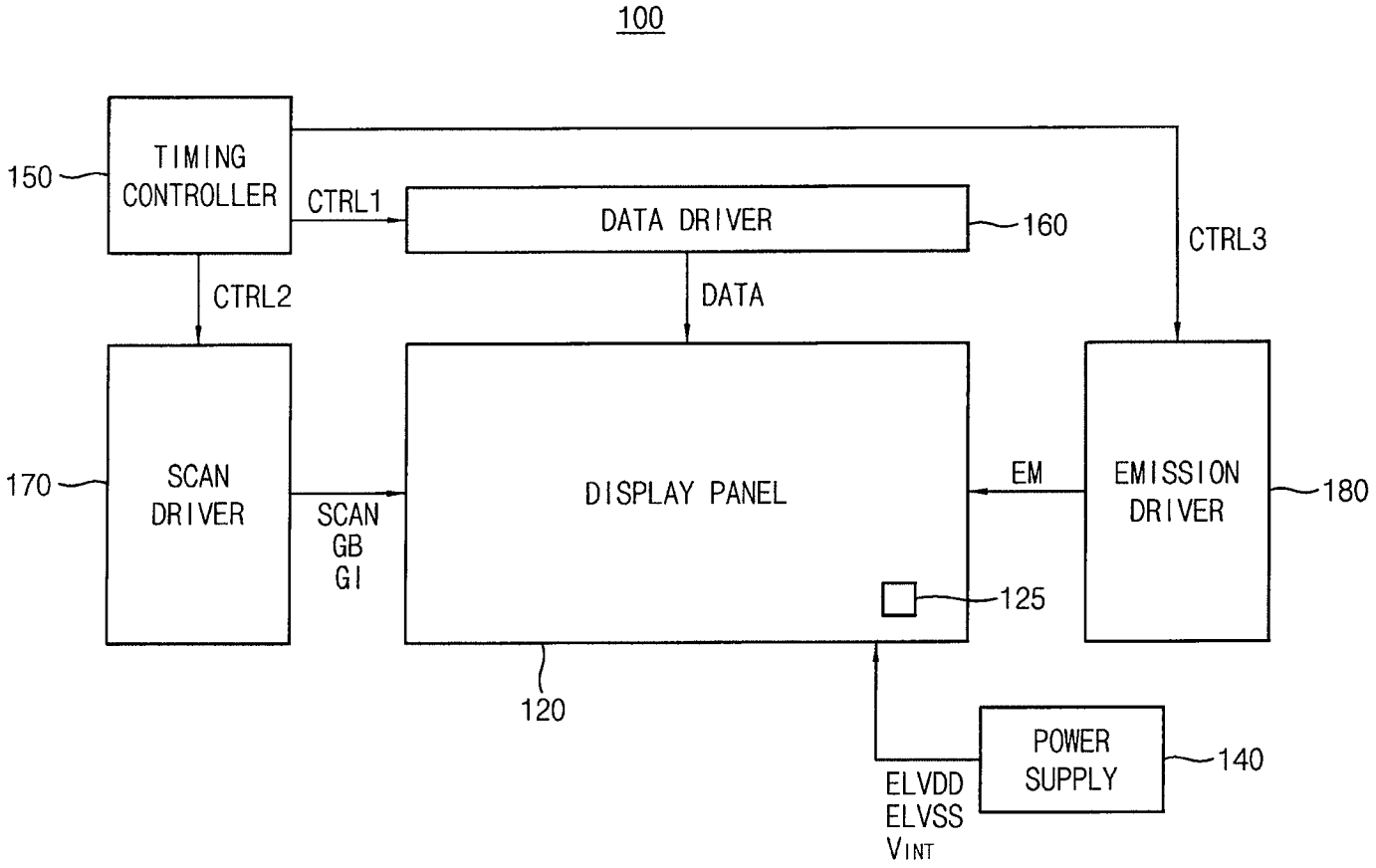
FIG. 1 is a block diagram illustrating an OLED display according to example embodiments.

When the amount of electric charge required for a green OLED to emit light is greater than the amount of the electric charge required for the other OLEDs to emit light, the turn-on of the green OLED can be delayed in comparison with the turn-on of the other OLEDs when the displayed images change from a black image to a white image. In other words, when a current frame includes the black image and a subsequent frame includes the white image, the red and blue OLEDs are turned on, and then the green OLED is turned on with a small delay. Thus, this results in color artifacts with purplish color.

Hereinafter, embodiments of the present inventive concept will be explained in detail with reference to the accompanying drawings. Like or similar reference numerals refer to like or similar elements throughout.

FIG. 1 is a block diagram illustrating an OLED display according to example embodiments.

Referring to FIG. 1, an OLED display 100 includes a display panel 120, a power supply 140, a timing controller 150, a data driver 160 and a scan driver 170. The OLED display 100 may further include an emission driver 180.

The display panel 120 includes a plurality of pixels 125. Each of the plurality of pixels 125 includes an OLED and a driving transistor. The OLED emits light based on an emission current. The driving transistor controls the emission current based on a data signal DATA applied to a gate electrode of the driving transistor. Detailed configurations and operations of one of the plurality of pixels 125 will be described with reference to FIGS. 3 through 5B.

The power supply 140 applies driving voltages ELVDD and ELVSS to the plurality of pixels 125 and applies an initialization voltage VINT to a first electrode of the OLED. The power supply 140 controls one of the driving voltages ELVDD and ELVSS within a first range and controls the initialization voltage VINT such that a voltage difference between one of the driving voltages ELVDD and ELVSS and the initialization voltage VINT is substantially fixed. The first range may be determined in designing and/or manufacturing processes for the OLED display 100.

Hereinafter, the example embodiments will be described based on controlling the driving voltage ELVSS within the first range. However, the example embodiments are not limited thereto. For example, the power supply 140 may control the driving voltage ELVDD within the first range.

In some example embodiments, the power supply 140 may control the driving voltage ELVSS based on a luminance mode of the display panel 120. The luminance mode of the display panel 120 may be changed by a user of the OLED display 100. For example, a low luminance mode may be set by the user to reduce power consumption of the display panel 120. For another example, a high luminance mode may be set by the user to increase visibility of the display panel 120. According to example embodiments, the luminance mode of the display panel 120 may be automatically changed by operating environments of the OLED display 100. Power consumption of the plurality of pixels 125 may be reduced by controlling the driving voltage ELVSS based on the luminance mode.

In addition, as described above, the power supply 140 may control the driving voltage ELVSS within the first range. In other words, the power supply 140 may control the driving voltage ELVSS within a range of maintaining an operating region of the driving transistor. In some example embodiments, the power supply 140 may control the driving voltage ELVSS within the first range such that the driving transistor operates in a saturation region. In other example embodiments, the power supply 140 may control the driving voltage ELVSS within the first range such that the driving transistor operates in a linear region. In still other example embodiments, the power supply 140 may control the driving voltage ELVSS within the first range such that the driving transistor operates adjacent to a boundary between the saturation region and the linear region. Even if the driving transistor operates adjacent to the boundary between the saturation region and the linear region, the driving voltage ELVSS may be changed within the range of maintaining the operating region of the driving transistor, and the power consumption of the plurality of pixels 125 may also be reduced by controlling the driving voltage ELVSS within the range of maintaining the operating region of the driving transistor. For example, the power consumption may be reduced as a level of the driving voltage ELVSS decreases. To operate the driving transistor in the linear region and to minimize the level of the driving voltage ELVSS, the power supply 140 may control the driving voltage ELVSS within the first range such that the driving transistor operates adjacent to the boundary between the saturation region and the linear region.

In some example embodiments, the power supply 140 may set the initialization voltage VINT by adding a reverse voltage to the driving voltage ELVSS. The reverse voltage may be predetermined in the designing and/or manufacturing processes for the OLED display 100. When the initialization voltage VINT set by adding the reverse voltage to the driving voltage ELVSS is applied to the first electrode of the OLED, and when the driving voltage ELVSS is applied to a second electrode of the OLED, a voltage difference between the first electrode and the second electrode of the OLED may correspond to an absolute value of the reverse voltage. Since the OLED does not emit light when the data signal DATA corresponding to zero luminance (e.g., black) is applied to a pixel having the OLED, and since the OLED emits light when the voltage difference between the first electrode and the second electrode of the OLED is greater than a threshold voltage, the absolute value of the reverse voltage may be equal to or smaller than the threshold voltage. In other words, the reverse voltage may correspond to the voltage difference between the first electrode and the second electrode when the OLED does not emit light, and the absolute value of the reverse voltage may be equal to or smaller than the threshold voltage. However, when the absolute value of the reverse voltage is excessively smaller than the threshold voltage, the amount of electric charges to be stored in a parasitic capacitor connected in parallel to the OLED may increase, and thus time to be required for the OLED to emit light may increase.

In some example embodiments, in a pixel including at least one p-type metal oxide semiconductor (PMOS) transistor, the initialization voltage VINT may be applied to an anode electrode of the OLED in the pixel. In addition, in the pixel including the at least one PMOS transistor, the absolute value of the reverse voltage may be equal to or smaller than (Vth−Qe/Cel), where Vth represents a threshold voltage of the driving transistor, Qe represents the amount of electric charges included in the emission current during an emission period in a single frame when the OLED has zero luminance (e.g., black), and Cel represents a capacitance of the parasitic capacitor connected in parallel to the OLED. Qe may be obtained by multiplying the emission current when the OLED has zero luminance by the emission period in the single frame.

After the initialization voltage VINT is set by adding the reverse voltage equal to or smaller than (Vth−Qe/Cel) to the driving voltage ELVSS, the OLED may not emit when the data signal DATA corresponding to zero luminance is applied to the pixel. To minimize the time to be required for emitting the OLED, the reverse voltage may be set to (Vth−Qe/Cel). Although the example of the reverse voltage for the pixel having the at least one PMOS transistor is described above, the reverse voltage is not limited thereto.

In some example embodiments, the plurality of pixels 125 may include a first pixel and a second pixel. The reverse voltage may be set for each pixel, and a first reverse voltage for the first pixel may be different from a second reverse voltage for the second pixel. For example, the first pixel may be one of a red pixel outputting red light, a green pixel outputting green light and a blue pixel outputting blue light, and the second pixel may be another one of the red pixel, the green pixel and the blue pixel. Typically, the red pixel may include a red OLED, the green pixel may include a green OLED, and the blue pixel may include a blue OLED. The green OLED may have relatively high emitting efficiency, and a capacitance of a parasitic capacitor connected in parallel to the green OLED may be greater than that of the red OLED and that of blue organic light-emitting diode. Thus, time to be required for emitting the green OLED may be relatively long. To substantially simultaneously emit all of the plurality of pixels 125, an absolute value of a reverse voltage for the green pixel may be smaller than an absolute value of a reverse voltage for the red pixel and an absolute value of a reverse voltage for the blue pixel.

In some example embodiments, the power supply 140 may include an adder that adds the reverse voltage to the driving voltage ELVSS. Detailed configurations and operations of the power supply 140 will be described with reference to FIG. 2.

In the OLED display 100 according to example embodiments, the power supply 140 may control the initialization voltage VINT such that the voltage difference between the driving voltage ELVSS and the initialization voltage VINT is substantially fixed or constant, and thus the power consumption of the plurality of pixels 125 may be reduced. In addition, the power supply 140 may set the initialization voltage VINT such that a difference between the initialization voltage VINT and the threshold voltage is minimized, and thus the time to be required for the OLED to emit light may be minimized. Accordingly, differences among time to be required for turning on the plurality of pixels 125 may be minimized, and color artifacts in the display panel 120 may be prevented.

The timing controller 150 may control an operation of the data driver 160 based on a data control signal CTRL1 and may control an operation of the scan driver 170 based on a scan control signal CTRL2. In addition, the timing controller 150 may control an operation of the emission driver 180 based on an emission control signal CTRL3. As described below with reference to FIGS. 5A and 5B, the timing controller 150 may perform a gamma compensating operation on the data signal DATA.

The data driver 160 may apply the data signal DATA to the plurality of pixels 125 based on the data control signal CTRL1. The data signal DATA that is appropriate to drive the plurality of pixels 125 may be generated based on image data and may be applied to the plurality of pixels 125 based on a scan signal SCAN.

The scan driver 170 may generate the scan signal SCAN and may apply the scan signal SCAN to the plurality of pixels 125 based on the scan control signal CTRL2. In some example embodiments, the scan driver 170 may generate a gate initialization signal GI and may apply the gate initialization signal GI to the plurality of pixels 125 based on the scan control signal CTRL2. Before the data signal DATA is applied to the plurality of pixels 125, the gate electrode of the driving transistor may be initialized based on the initialization voltage VINT when the gate initialization signal GI is applied to the plurality of pixels 125. In some example embodiments, the scan driver 170 may generate a diode initialization signal GB and may apply the diode initialization signal GB to the plurality of pixels 125 based on the scan control signal CTRL2. The first electrode of the OLED may be initialized when the diode initialization signal GB is applied to the plurality of pixels 125. Thus, when the data signal DATA corresponding to zero luminance is applied to the pixel, the OLED may not emit light.

The emission driver 180 may generate the emission signal EM and may apply the emission signal EM to the plurality of pixels 125 based on the emission control signal CTRL3. The emission periods of the plurality of pixels 125 in the single frame may be controlled based on the emission signal EM.

Figure 2:
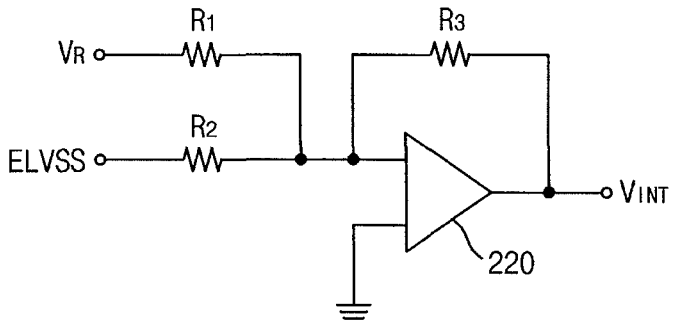
FIG. 2 is a circuit diagram illustrating an example of a power supply included in the OLED display of FIG. 1.

FIG. 2 is a circuit diagram illustrating an example of a power supply included in the OLED display of FIG. 1.

Referring to FIG. 2, a power supply may include an operational amplifier 220, a first resistor R1, a second resistor R2 and a third resistor R3.

The operational amplifier 220 may have a first input electrode connected to a ground voltage, a second input electrode and an output electrode outputting the initialization voltage VINT. The first resistor R1 may have a first terminal receiving the reverse voltage VR and a second terminal connected to the second input electrode of the operational amplifier 220. The second resistor R2 may have a first terminal receiving the driving voltage ELVSS and a second terminal connected to the second input electrode of the operational amplifier 220. The third resistor R3 may have a first terminal connected to the second input electrode of the operational amplifier 220 and a second terminal connected to the output electrode of the operational amplifier 220.

An output of the operational amplifier 220 may have a voltage level of about {−R3*(VR/R1+ELVSS/R2)}. Assuming that a resistance of the first resistor R1, a resistance of the second resistor R2 and a resistance of the third resistor R3 are substantially the same as each other, the output of the operational amplifier 220 may have a voltage level of about −(VR+ELVSS). Thus, the operational amplifier 220, the first resistor R1, the second resistor R2 and the third resistor R3 in the power supply may operate as an adder that adds the reverse voltage VR to the driving voltage ELVSS.

Although the example of the power supply generating the initialization voltage VINT applied to the pixel having the at least one PMOS transistor is described above with reference to FIG. 2, the reverse voltage is not limited thereto.

Figure 3:
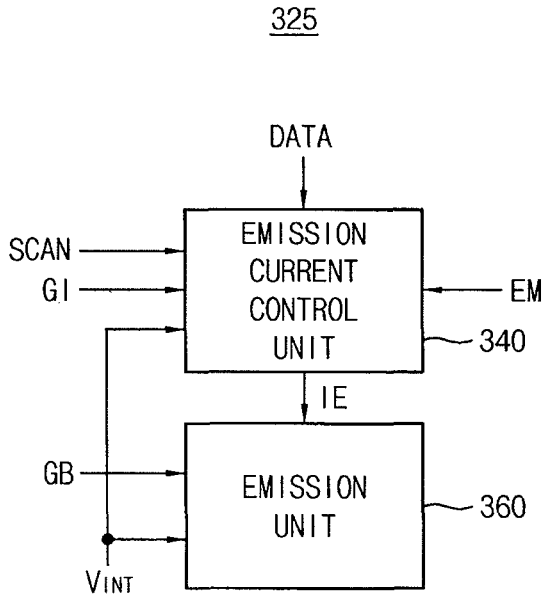
FIG. 3 is a block diagram illustrating an example of a pixel included in the OLED display of FIG. 1.

FIG. 3 is a block diagram illustrating an example of a pixel included in the OLED display of FIG. 1.

Referring to FIG. 3, a pixel 325 may include an emission current control unit 340 and an emission unit 360.

The emission current control unit 340 may include the driving transistor that controls an emission current IE based on the data signal DATA applied to the gate electrode of the driving transistor. The data signal DATA may be applied to the gate electrode of the driving transistor when the scan signal SCAN is activated. The data signal DATA may be stored in a storage capacitor that is connected to the gate electrode of the driving transistor and may be maintained during a predetermined period. When the gate initialization signal GI is activated, the emission current control unit 340 may apply the initialization voltage VINT to the gate electrode of the driving transistor. When the emission signal EM is activated, the emission current control unit 340 may apply the emission current IE to the emission unit 360.

The emission unit 360 may include the OLED that emits light based on the emission current IE. When the diode initialization signal GB is activated, the emission unit 360 may apply the initialization voltage VINT to the first electrode of the OLED.

In some example embodiments, the emission current control unit 340 and the emission unit 360 may operate based on the driving voltages ELVDD and ELVSS in FIG. 1.

Figure 4:
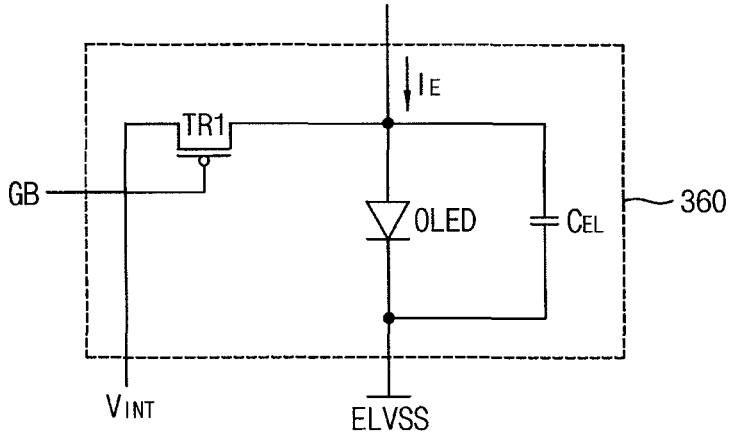
FIG. 4 is a circuit diagram illustrating an example of an emission unit included in the pixel of FIG. 3.

FIG. 4 is a circuit diagram illustrating an example of an emission unit included in the pixel of FIG. 3.

Referring to FIG. 4, the emission unit 360 may include an OLED, a diode initialization transistor TR1 and a parasitic capacitor CEL.

The OLED may output light based on the emission current IE applied to the emission unit 360. A first electrode of the OLED may receive the emission current IE, and a second electrode of the OLED may be connected to the driving voltage ELVSS. The diode initialization transistor TR1 may perform a switching operation and may apply the initialization voltage VINT to the first electrode (e.g., an anode electrode) of the OLED based on the diode initialization signal GB applied to a gate electrode of the diode initialization transistor TR1.

In some example embodiments, when the data signal DATA applied to the gate electrode of the driving transistor corresponds to zero luminance, a bypass for the emission current IE may be formed by the parasitic capacitor CEL connected in parallel to the OLED.

Although the example of the emission unit 360 having at least one PMOS transistor is described above with reference to FIG. 4, the emission unit is not limited thereto.

Figure 5A:
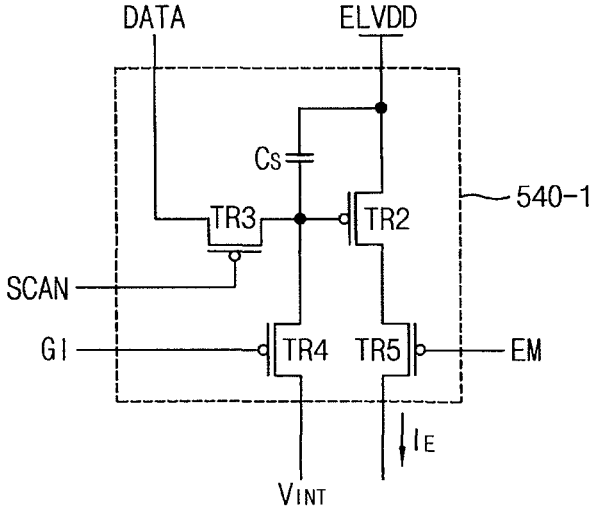
FIG. 5A is a circuit diagram illustrating an example of an emission current control unit included in the pixel of FIG. 3.

FIG. 5A is a circuit diagram illustrating an example of an emission current control unit included in the pixel of FIG. 3.

Referring to FIG. 5A, an emission current control unit 540-1 may include a storage capacitor CS, a driving transistor TR2, a data applying transistor TR3, a data initialization transistor TR4 and an emission control transistor TR5.

The data applying transistor TR3 may have a first electrode receiving the data signal DATA, a gate electrode receiving the scan signal SCAN and a second electrode connected to a gate electrode of the driving transistor TR2. When the scan signal SCAN is activated, the data applying transistor TR3 may directly apply the data signal DATA to the gate electrode of the driving transistor TR2.

The driving transistor TR2 may have a first electrode receiving the driving voltage ELVDD, the gate electrode and a second electrode connected to the emission control transistor TR5. The driving transistor TR2 may control the emission current IE based on the data signal DATA directly applied to the gate electrode of the driving transistor TR2.

The storage capacitor CS may have a first electrode connected to the driving voltage ELVDD and a second electrode connected to the gate electrode of the driving transistor TR2. The storage capacitor CS may maintain the data signal DATA directly applied to the gate electrode of the driving transistor TR2 during the predetermined period.

The data initialization transistor TR4 may have a first electrode receiving the initialization voltage VINT, a gate electrode receiving the gate initialization signal GI and a second electrode connected to the gate electrode of the driving transistor TR2. When the gate initialization signal GI is activated, the data initialization transistor TR4 may apply the initialization voltage VINT to the gate electrode of the driving transistor TR2.

The emission control transistor TR5 may have a first electrode connected to the second electrode of the driving transistor TR2, a gate electrode receiving the emission signal EM and a second electrode connected to the emission unit 360 in FIG. 3. When the emission signal EM is activated, the emission control transistor TR5 may apply the emission current IE to the emission unit 360 in FIG. 3.

In some example embodiments, the initialization voltage VINT may be applied to the gate electrode of the driving transistor TR2. The timing controller 150 in FIG. 1 may perform the gamma compensating operation on the data signal DATA based on changes of the driving voltage ELVSS and the initialization voltage VINT. If the initialization voltage VINT is changed, the data signal DATA applied to the gate electrode of the driving transistor TR2 may also be changed. Thus, the timing controller 150 in FIG. 1 may perform the gamma compensating operation on the data signal DATA after the initialization voltage VINT is changed.

Although the example of the emission current control unit 540-1 having at least one PMOS transistor is described above with reference to FIG. 5A, the emission current control unit is not limited thereto.

Figure 5B:
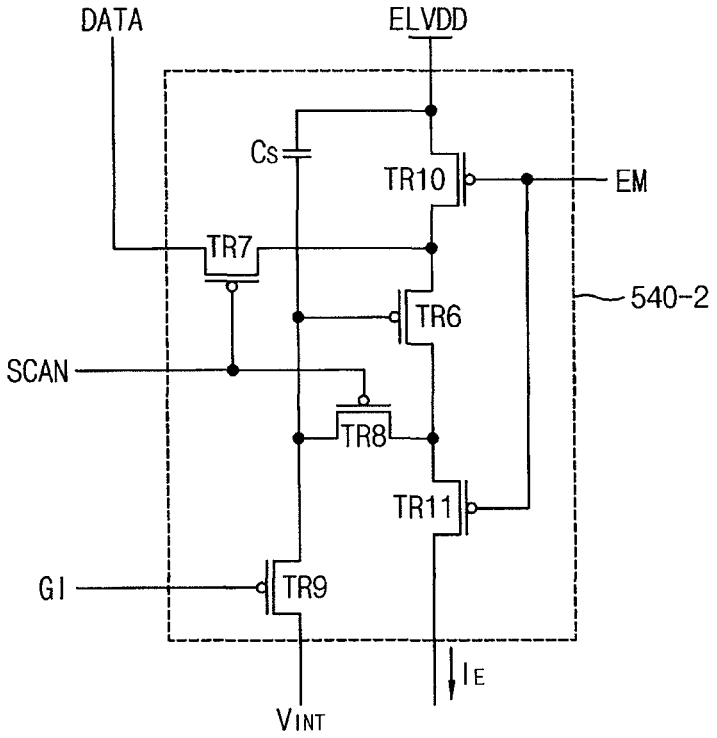
FIG. 5B is a circuit diagram illustrating another example of the emission current control unit included in the pixel of FIG. 3.

FIG. 5B is a circuit diagram illustrating another example of the emission current control unit included in the pixel of FIG. 3.

Referring to FIG. 5B, an emission current control unit 540-2 may include a storage capacitor CS, a driving transistor TR6, a first data applying transistor TR7, a second data applying transistor TR8, a data initialization transistor TR9, a first emission control transistor TR10 and a second emission control transistor TR11.

The first data applying transistor TR7 may have a first electrode receiving the data signal DATA, a gate electrode receiving the scan signal SCAN and a second electrode connected to a first electrode of the driving transistor TR6. When the scan signal SCAN is activated, the first data applying transistor TR7 may apply the data signal DATA to the first electrode of the driving transistor TR6.

The second data applying transistor TR8 may have a first electrode connected to a second electrode of the driving transistor TR6, a gate electrode receiving the scan signal SCAN and a second electrode connected to a gate electrode of the driving transistor TR6. When the scan signal SCAN is activated, the second data applying transistor TR8 may connect the second electrode of the driving transistor TR6 with the gate electrode of the driving transistor TR6, and thus the driving transistor TR6 may operate as a diode. The data signal DATA may be applied to the gate electrode of the driving transistor TR6 through the first and second electrodes of the driving transistor TR6. In other words, the data signal DATA may be indirectly applied to the gate electrode of the driving transistor TR6.

In addition, when the data signal DATA passes through the driving transistor TR6, a voltage level of the data signal DATA may be reduced by a threshold voltage of the driving transistor TR6. Thus, when the driving transistor TR6 controls the emission current IE, some disadvantages in the emission current IE caused by the threshold voltage of the driving transistor TR6 may be cancelled, and non-uniformity of image quality due to the threshold voltage in the OLED display may be prevented.

The driving transistor TR6 may control the emission current IE based on the data signal DATA indirectly applied to the gate electrode of the driving transistor TR6.

The storage capacitor CS may have a first electrode connected to the driving voltage ELVDD and a second electrode connected to the gate electrode of the driving transistor TR6. The storage capacitor CS may maintain the data signal DATA indirectly applied to the gate electrode of the driving transistor TR6 during the predetermined period.

The data initialization transistor TR9 may have a first electrode receiving the initialization voltage VINT, a gate electrode receiving the gate initialization signal GI and a second electrode connected to the gate electrode of the driving transistor TR6. When the gate initialization signal GI is activated, the data initialization transistor TR9 may apply the initialization voltage VINT to the gate electrode of the driving transistor TR6.

The first emission control transistor TR10 may have a first electrode connected to the driving voltage ELVDD, a gate electrode receiving the emission signal EM and a second electrode connected to the first electrode of the driving transistor TR6. When the emission signal EM is activated, the first emission control transistor TR10 may connect the driving voltage ELVDD with the driving transistor TR6.

The second emission control transistor TR11 may have a first electrode connected to the second electrode of the driving transistor TR6, a gate electrode receiving the emission signal EM and a second electrode connected to the emission unit 360 in FIG. 3. When the emission signal EM is activated, the second emission control transistor TR11 may apply the emission current IE to the emission unit 360 in FIG. 3.

In some example embodiments, the initialization voltage VINT may be applied to the gate electrode of the driving transistor TR6. The timing controller 150 in FIG. 1 may perform the gamma compensating operation on the data signal DATA based on changes of the driving voltage ELVSS and the initialization voltage VINT. If the initialization voltage VINT is changed, the data signal DATA applied to the gate electrode of the driving transistor TR6 may also be changed. Thus, the timing controller 150 in FIG. 1 may perform the gamma compensating operation on the data signal DATA after the initialization voltage VINT is changed.

Although the example of the emission current control unit 540-2 having at least one PMOS transistor is described above with reference to FIG. 5B, the emission current control unit is not limited thereto.

Figure 6:
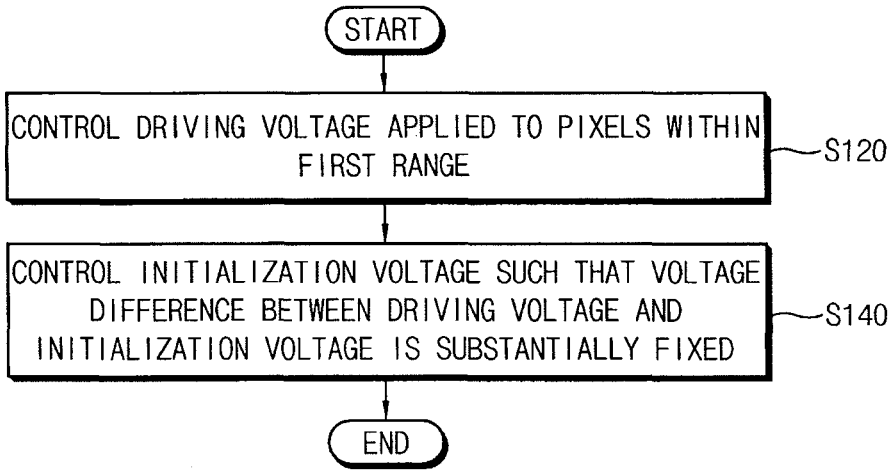
FIG. 6 is a flow chart illustrating a method of setting an initialization voltage in an OLED display according to example embodiments.

FIG. 6 is a flowchart illustrating a method of setting an initialization voltage in an OLED display according to example embodiments. In some embodiments, the FIG. 6 procedure is implemented in a conventional programming language, such as C or C++ or another suitable programming language. The program can be stored on a computer accessible storage medium of the energy storage system 1, for example, a memory (not shown) of the OLED display 100. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 6.

Referring to FIG. 6, in a method of setting an initialization voltage in an OLED display according to example embodiments, a driving voltage is controlled within a first range (step S120), and the initialization voltage is controlled such that a voltage difference between the driving voltage and the initialization voltage is substantially fixed or constant (step S140). The OLED display includes a plurality of pixels each of which includes an OLED emitting light based on an emission current and a driving transistor controlling the emission current based on a data signal applied to a gate electrode of the driving transistor.

In the step S120, the driving voltage is controlled and is applied to the plurality of pixels.

In some example embodiments, the driving voltage may be controlled based on a luminance mode of the OLED display. The luminance mode may be changed by a user of the OLED display. For example, a low luminance mode may be set by the user to reduce power consumption of a display panel included in the OLED display. For another example, a high luminance mode may be set by the user to increase visibility of the display panel. According to example embodiments, the luminance mode may be automatically changed by operating environments of the OLED display. Power consumption of the plurality of pixels may be reduced by controlling the driving voltage based on the luminance mode.

In addition, as described above, the driving voltage may be controlled within the first range. In other words, the driving voltage may be controlled within a range of maintaining an operating region of the driving transistor. In some example embodiments, the driving voltage may be controlled within the first range such that the driving transistor operates in a saturation region. In other example embodiments, the driving voltage may be controlled within the first range such that the driving transistor operates in a linear region. In still other example embodiments, the driving voltage may be controlled within the first range such that the driving transistor operates adjacent to a boundary between the saturation region and the linear region. Even if the driving transistor operates adjacent to the boundary between the saturation region and the linear region, the driving voltage may be changed within the range of maintaining the operating region of the driving transistor, and the power consumption of the plurality of pixels may also be reduced by controlling the driving voltage within the range of maintaining the operating region of the driving transistor. For example, the power consumption may be reduced as a level of the driving voltage decreases. To operate the driving transistor in the linear region and to minimize the level of the driving voltage, the driving voltage may be controlled within the first range such that the driving transistor operates adjacent to the boundary between the saturation region and the linear region.

In the step S140, the initialization voltage is controlled and is applied to a first electrode of the OLED.

In some example embodiments, the initialization voltage may be set by adding a reverse voltage to the driving voltage. When the initialization voltage set by adding the reverse voltage to the driving voltage is applied to the first electrode of the OLED, and when the driving voltage is applied to a second electrode of the OLED, a voltage difference between the first electrode and the second electrode of the OLED may correspond to an absolute value of the reverse voltage. Since the OLED does not emit light when the data signal corresponding to zero luminance (e.g., black) is applied to a pixel having the OLED, and since the OLED emits light when the voltage difference between the first electrode and the second electrode of the OLED is greater than a threshold voltage, the absolute value of the reverse voltage may be equal to or smaller than the threshold voltage. In other words, the reverse voltage may correspond to the voltage difference between the first electrode and the second electrode when the OLED does not emit light, and the absolute value of the reverse voltage may be equal to or smaller than the threshold voltage. However, when the absolute value of the reverse voltage is excessively smaller than the threshold voltage, the amount of electric charges to be stored in a parasitic capacitor connected in parallel to the OLED may increase, and thus time to be required for the OLED to emit light may increase.

In some example embodiments, in a pixel including at least one PMOS transistor, the initialization voltage may be applied to an anode electrode of the OLED in the pixel. In addition, in the pixel including the at least one PMOS transistor, the absolute value of the reverse voltage may be equal to or smaller than (Vth−Qe/Cel), where Vth represents a threshold voltage of the driving transistor, Qe represents the amount of electric charges included in the emission current during an emission period in a single frame when the OLED has zero luminance (e.g., black), and Cel represents a capacitance of the parasitic capacitor connected in parallel to the OLED. Qe may be obtained by multiplying the emission current when the OLED has zero luminance by the emission period in the single frame.

After the initialization voltage is set by adding the reverse voltage equal to or smaller than (Vth−Qe/Cel) to the driving voltage, the OLED may not emit light when the data signal corresponding to zero luminance is applied to the pixel. To minimize the time to be required for emitting the OLED, the reverse voltage may be set to (Vth−Qe/Cel). Although the example of the reverse voltage for the pixel having the at least one PMOS transistor is described above, the reverse voltage is not limited thereto.

In the method of setting the initialization voltage in the OLED display according to example embodiments, the initialization voltage may be controlled such that the voltage difference between the driving voltage and the initialization voltage is substantially fixed or constant, and thus the power consumption of the plurality of pixels may be reduced. In addition, the initialization voltage may be set such that a difference between the initialization voltage and the threshold voltage is minimized, and thus the time to be required for emitting the OLED may be minimized. Accordingly, differences among time to be required for turning on the plurality of pixels may be minimized, and color artifacts in the display panel may be prevented.

In some example embodiments, the initialization voltage may be applied to the gate electrode of the driving transistor. A gamma compensating operation may be performed on the data signal based on changes of the driving voltage and the initialization voltage. If the initialization voltage is changed, the data signal applied to the gate electrode of the driving transistor may also be changed. Thus, the gamma compensating operation may be performed on the data signal after the initialization voltage is changed.

In some example embodiments, when the data signal applied to the gate electrode of the driving transistor corresponds to zero luminance, a bypass for the emission current may be formed by a parasitic capacitor connected in parallel to the OLED.

Although the example embodiments are described based on a pixel including at least one PMOS transistor, the example embodiments are not limited thereto.

The present inventive concept may be applied to an electronic device having an OLED display. For example, the present inventive concept may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An organic light-emitting diode (OLED) display comprising:

a display panel including a plurality of pixels, each of the pixels including an OLED and a driving transistor, the OLED configured to emit light based on an emission current during an emission period of an image frame, the driving transistor configured to control the emission current based on a data signal applied to a gate electrode of the driving transistor; and a power supply configured to apply a driving voltage to the pixels, apply an initialization voltage to a first electrode of the OLED so as to initialize the first electrode during an initialization period preceding the emission period of the image frame, control the driving voltage within a first range, and control the initialization voltage such that a voltage difference between the driving voltage and the initialization voltage remains substantially constant during the initialization period, wherein the driving voltage is directly applied to a second electrode of the OLED, and wherein the power supply is configured to set the initialization voltage by adding a reverse voltage to the driving voltage, the reverse voltage corresponding to a voltage difference between the first electrode and a second electrode of the OLED when the OLED does not emit light.

2. The OLED display of claim 1, wherein the power supply is configured to control the driving voltage based on a luminance mode of the display panel.

3. The OLED display of claim 1, wherein the power supply is configured to control the driving voltage within the first range such that the driving transistor operates in a saturation region.

4. The OLED display of claim 1, wherein the power supply is configured to control the driving voltage within the first range such that the driving transistor operates adjacent to a boundary between a saturation region and a linear region.

5. The OLED display of claim 1, wherein the reverse voltage is configured to be set for each pixel, and a first reverse voltage for a first pixel among the pixels is different from a second reverse voltage for a second pixel among the pixels.

6. The OLED display of claim 5, wherein the first pixel is one of a red pixel configured to emit red light, a green pixel configured to emit green light and a blue pixel configured to emit blue light, and wherein the second pixel is another one of the red pixel, the green pixel and the blue pixel.

7. The OLED display of claim 1, wherein an absolute value of the reverse voltage is less than or substantially equal to (Vth-Qe/Cel), where Vth represents a threshold voltage of the driving transistor, Qe represents an amount of electric charges included in the emission current during an emission period in a single frame when the OLED has zero luminance, and Cel represents a capacitance of a parasitic capacitor connected in parallel to the OLED.

8. The OLED display of claim 1, wherein the power supply includes an adder configured to add the reverse voltage to the driving voltage.

9. The OLED display of claim 1, wherein the first electrode of the OLED corresponds to an anode electrode of the OLED.

10. The OLED display of claim 1, further comprising:

a timing controller configured to perform a gamma compensating operation on the data signal based on changes of the driving voltage and the initialization voltage, and wherein the gate electrode of the driving transistor is configured to receive the initialization voltage.

11. The OLED display of claim 1, wherein when the data signal applied to the gate electrode of the driving transistor corresponds to zero luminance, a parasitic capacitor connected in parallel to the OLED is configured to form a bypass for the emission current.

12. A method of setting an initialization voltage in an organic light-emitting diode (OLED) display including a plurality of pixels, each of the pixels including an OLED configured to emit light based on an emission current during an emission period of an image frame and a driving transistor configured to control the emission current based on a data signal applied to a gate electrode of the driving transistor, the method comprising:

controlling a driving voltage within a first range, the driving voltage being applied to the pixels; and controlling the initialization voltage during an initialization period preceding the emission period of the image frame such that a voltage difference between the driving voltage and the initialization voltage remains substantially constant during the initialization period, the initialization voltage being applied to a first electrode of the OLED, wherein the driving voltage is directly applied to a second electrode of the OLED, and wherein the controlling of the driving voltage includes: setting the initialization voltage by adding a reverse voltage to the driving voltage, the reverse voltage corresponding to a voltage difference between the first electrode and a second electrode of the OLED when the OLED does not emit light.

13. The method of claim 12, wherein the controlling of the driving voltage includes:

controlling the driving voltage based on a luminance mode of the OLED display.

14. The method of claim 12, wherein the controlling of the driving voltage includes:

controlling the driving voltage within the first range such that the driving transistor operates in a saturation region.

15. The method of claim 12, wherein the controlling of the initialization voltage includes:

controlling the driving voltage within the first range such that the driving transistor operates in a boundary region between a saturation region and a linear region.

16. The method of claim 12, wherein an absolute value of the reverse voltage is less than or substantially equal to (Vth-Qe/Cel), where Vth represents a threshold voltage of the driving transistor, Qe represents an amount of electric charges included in the emission current during an emission period in a single frame when the OLED has zero luminance, and Cel represents a capacitance of a parasitic capacitor connected in parallel to the OLED.

17. The method of claim 12, further comprising:

performing a gamma compensating operation on the data signal based on changes of the driving voltage and the initialization voltage, and wherein the initialization voltage is applied to the gate electrode of the driving transistor.

18. The method of claim 12, wherein when the data signal applied to the gate electrode of the driving transistor corresponds to zero luminance, a bypass for the emission current is formed by a parasitic capacitor connected in parallel to the OLED.

19. An organic light-emitting diode (OLED) display comprising:

a display panel including a plurality of pixels, each of the pixels including an OLED and a driving transistor, the display panel configured to emit light during an emission period of an image frame; and a power supply configured to apply a driving voltage and an initialization voltage to the display panel during an initialization period preceding the emission period of the image frame, and control the initialization voltage such that a voltage difference between the driving voltage and the initialization voltage remains substantially constant during the initialization period, the power supply comprising:

an adder configured to add a constant voltage to the driving voltage to generate the initialization voltage, wherein the initialization voltage is applied to a first electrode of the OLED, and the driving voltage is directly applied to a second electrode of the OLED, and wherein the power supply is further configured to control the driving voltage within a first range.

20. The OLED display of claim 19, wherein the power supply further configured to control the driving voltage within a first range.

21. The OLED display of claim 19, wherein the power supply includes:

an amplifier including a first input electrode connected to a ground voltage, a second input electrode, and an output electrode outputting the initialization voltage;

a first resistor connected between the constant voltage and the second input electrode of the amplifier;

a second resistor connected between the driving voltage and the second input electrode of the amplifier; and a third resistor connected between the second input electrode of the amplifier and the output electrode of the amplifier.

* * * * *